United States Patent [19]

Classon

[11] 3,973,077

[45] Aug. 3, 1976

[54] BUSHING FOR ELECTRICAL CONNECTION

[75] Inventor: Åke Classon, Ludvika, Sweden

[73] Assignee: Allmanna Svenska Elektriska Aktiebolaget, Vasteras, Sweden

[22] Filed: Nov. 7, 1975

[21] Appl. No.: 629,790

[30] Foreign Application Priority Data

Nov. 19, 1974 Sweden ..... 7414502

[52] U.S. Cl. ..... 174/15 BH; 174/12 BH; 174/31 R; 174/153 R

[51] Int. Cl.[2] ..... H01B 17/26

[58] Field of Search ..... 174/11 BH, 12 BH, 14 BH, 174/15 BH, 16 BH, 18, 31 R, 142, 143, 152 R, 153 R, 167

[56] References Cited

UNITED STATES PATENTS

| | | | |
|---|---|---|---|
| 1,983,335 | 12/1934 | Austin | 174/153 R X |
| 3,172,943 | 3/1965 | Sindahl et al. | 174/12 BH X |

FOREIGN PATENTS OR APPLICATIONS

| | | | |
|---|---|---|---|
| 90,977 | 12/1937 | Sweden | 174/153 R |

*Primary Examiner*—Laramie E. Askin

[57] ABSTRACT

A bushing for leading an electrical connector through a wall or the like has an intermediate flange for attachment in the wall and two metallic end flanges on either side of the intermediate flange. Two hollow insulating bodies are clamped between the intermediate flange and the end flanges, and a bushing conductor runs the length of the bushing. The bushing conductor is movable in relation to the remainder of the bushing or at least in relation to one of the end flanges. A drawing member is connected between the end flanges and is composed of first and second elongated metallic bodies each of which is attached to the corresponding end flanges overlapping each other for a certain distance. A pressure transmitting member, which is formed of a material with a greater coefficient of thermal expansion than the first and second metallic bodies, forms a power transmitting connection between the free ends of the metallic bodies.

7 Claims, 4 Drawing Figures

BUSHING FOR ELECTRICAL CONNECTION

BACKGROUND OF THE INVENTION

1. Field of the Invention

The present invention relates to a bushing for leading an electrical connector through a wall or the like, comprising an intermediate flange for attachment in the wall, two metallic end flanges arranged on either side of the intermediate flange and two hollow insulators clamped between the intermediate flange and the end flanges, and a bushing conductor running through the whole bushing.

2. The Prior Art

From Swedish Patent No. 90 977, for example, it is known, in such a bushing, to let a central bushing conductor together with the end flanges serve as a device for clamping together the above-mentioned bodies of insulating material.

When the bushing is mounted, the bushing conductor is given such a prestress large enough to fix the main parts of the bushing by means of frictional forces. Since, for example, ceramic material has a very low coefficient of thermal expansion in comparison with metal, the bushing conductor will have a greater extension with increasing temperature than the insulators which are pressed against the middle flange, which may have the result that the clamping force becomes too low at increasing temperature. With decreasing temperature, there may be a risk that the bushing conductor will be stretched beyond the range of elastic tension and will acquire a permanent plastic extension. This may have the result that the clamping force becomes even lower in the case of renewed heating.

SUMMARY OF THE INVENTION

The above-mentioned drawbacks are avoided with a bushing according to the invention by the fact that the bushing conductor is used only for its electrical function, whereas a separate drawing member containing a plurality of series-connected power-transmitting elements is used for clamping the insulators together. When these elements are made of the same material, a considerable advantage is obtained, since the mechanical series-connection means that a considerably extended elasticity is obtained. According to a further development of the invention, the above-mentioned elements are made of materials with different coefficients of thermal expansion, by means of which the length of the clamping member, in a manner known per se, will become almost independent of the variations in temperature.

According to the invention, the drawing member for drawing the two end flanges towards each other is formed of first and second elongated metallic bodies, each attached to one of the end flanges, which overlap each other for a certain distance and a pressure transmitting member which forms a power transmitting connection between the free ends of the metallic bodies.

BRIEF DESCRIPTION OF THE DRAWINGS

In the following, the invention will be described with reference to the accompanying schematic drawings, in which.

DESCRIPTION OF THE PREFERRED EMBODIMENTS

Figure 1:
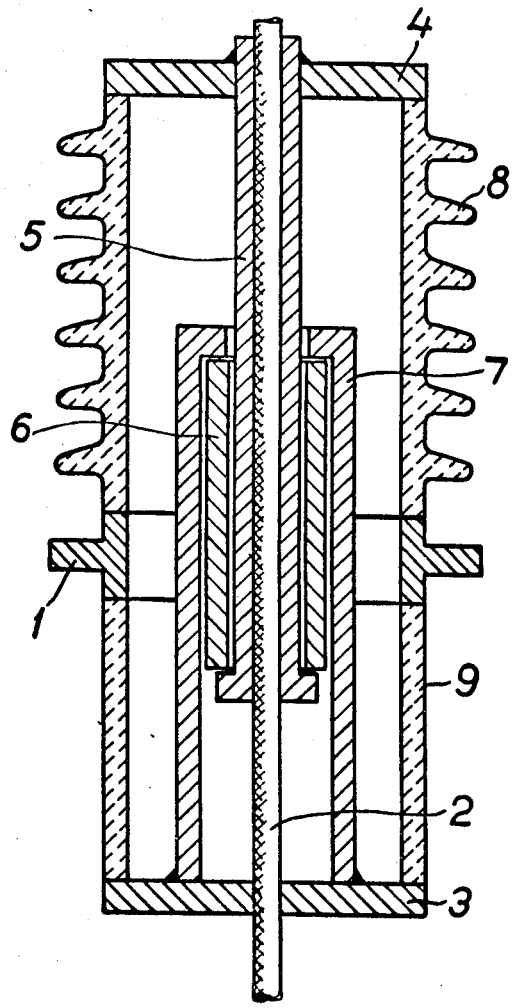
FIGS. 1, 2, 3 and 4 show four different embodiments of the invention in axial section.

In FIG. 1, 1 designates an intermediate flange which is intended to attach the bushing to a wall or the like. The current is conducted through the bushing by means of a flexible electric conductor 2, the ends of which are electrically connected each to one of the metallic end flanges 3 and 4. Each of these end flanges makes contact with a porcelain insulator 8 and 9. The concentric tubes 5, 6 and 7 together form a drawing member with the help of which the end flanges 3 and 4 are drawn towards each other, so that the two porcelain insulators 8 and 9 are each pressed against an annular surface of the intermediate flange 1.

The tubes 5 and 7 are made of steel and are each attached to an end flange, whereas the central tube 6 is made of aluminium and arranged to be loaded with compressive stress and thus to transmit a force between the tubes 5 and 7. Thermal expansion of the steel tubes 5 and 7 is characterised by the coefficient $12 \times 10^{-6}$, and tends to increase the distance between the end flanges 3 and 4. Thermal expansion of the tube 6 takes place with the coefficient of thermal expansion $24 \times 10^{-6}$ and tends to reduce the distance between the end flanges 3 and 4. The ceramic material in the insulator 8 and 9 has a coefficient of thermal expansion of about $3 \times 10^{-6}$.

In order that the construction shown can be used, the length of the tube 6 must, of course, be smaller than the total axial dimension of the parts 9, 1 and 8. The selection of material stated above makes it possible to fulfil this condition and at the same time to have a full temperature compensation for the bushing, which means that the retaining force operating on the insulators 8 and 9 will be nearly independent of the temperature.

If the current is conducted through a conductor in the center, as shown in FIG. 1, the tubes 5 and 7 are suitably constructed of non-magnetic stainless steel to avoid heat losses because of eddy currents.

Figure 2:
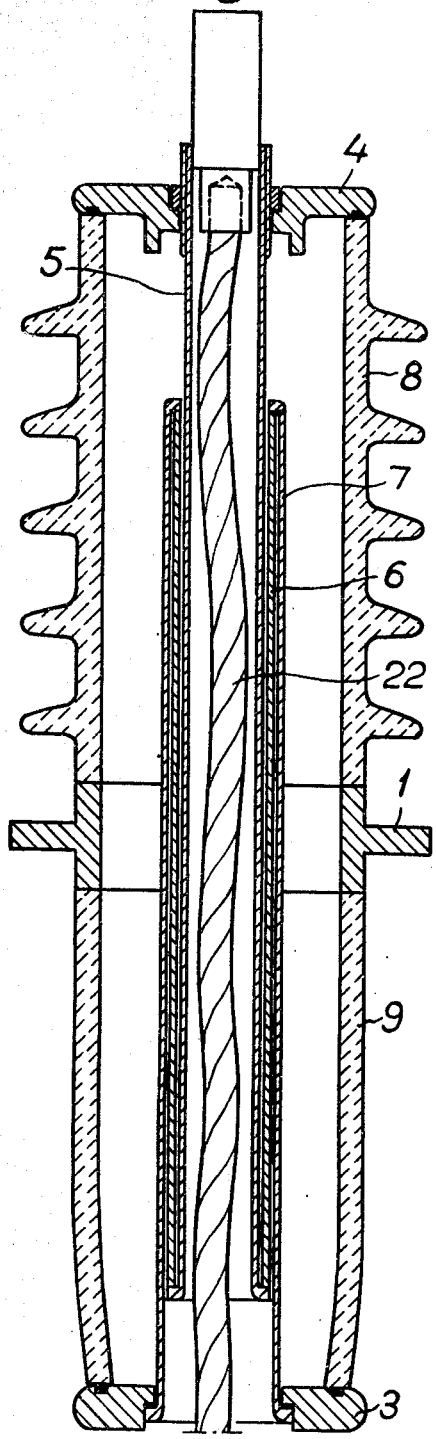
Figure 3:
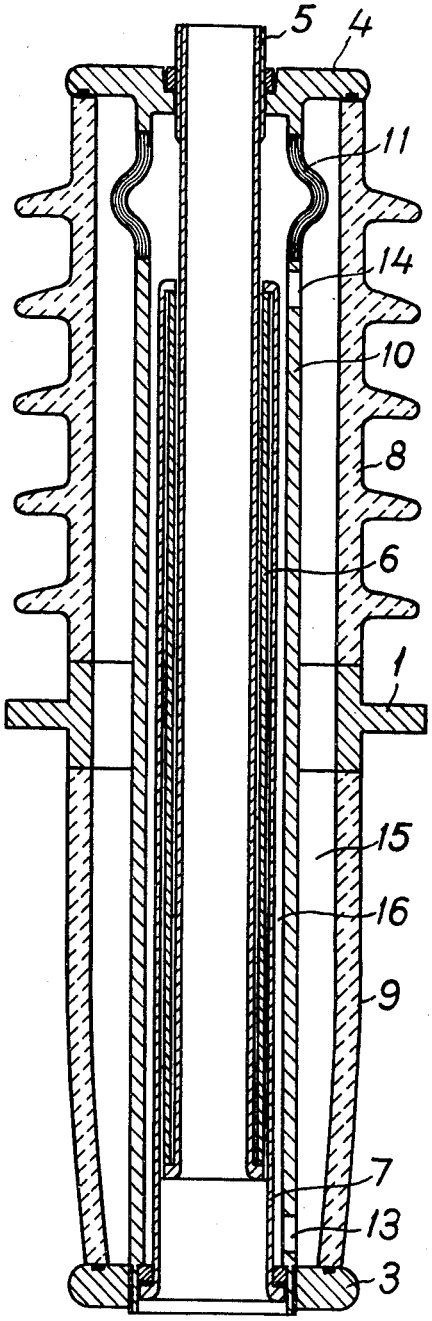
Figure 4:
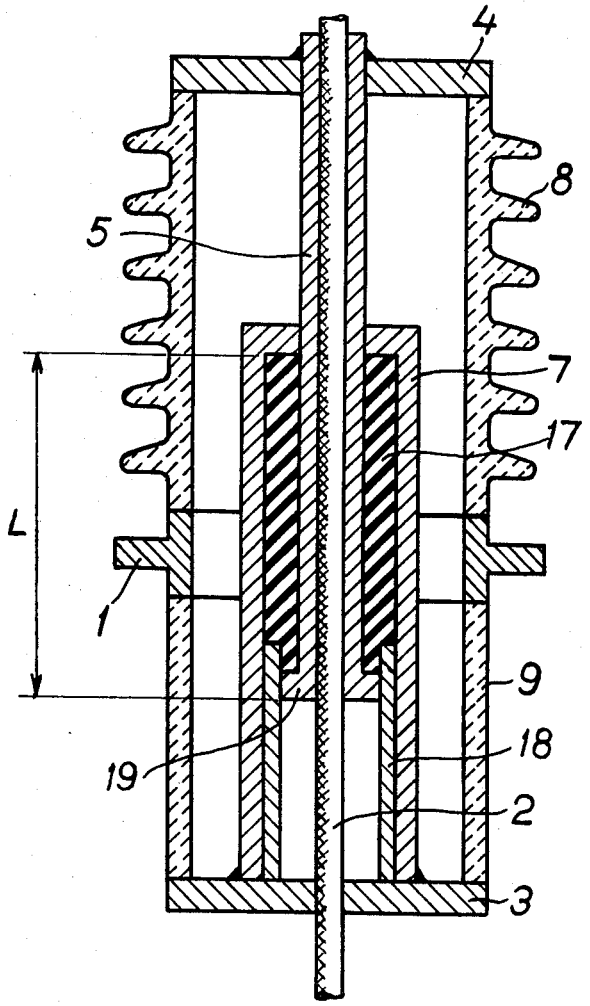

In FIGS. 2, 3 and 4 the references used in connection with FIG. 1 also apply.

FIG. 2 differs fundamentally from FIG. 1 by the fact that a bushing conductor 22 is used which is fastened to the bushing at one end only. According to the drawing, the conductor 22 is constructed as a flexible conductor, but since it is attached only at one end it might just as well be made as a stiff rod.

Instead of the central conductors 2 and 22, shown in FIGS. 1 and 2, a conductor tube 10 of aluminium or copper is used, according to FIG. 3, which tube is connected between the end flanges in the series connection with a flexible conductor element 11. The conductor tube 10 is provided at the ends with openings 13 and 14 for coolant in the form of liquid or gas. From a space 15, lying radially outside the tube 10, cooling liquid, for example, passes through the opening 13 to a space 16 lying radially inside the tube 10, which liquid then flows back at the other end of the bushing through the opening 14. Thus, a cooling system is obtained merely by providing the openings 13 and 14.

The embodiment of the invention shown in FIG. 4 is only one of several feasible embodiments, which differs from the one shown in FIG. 1 substantially by the fact that the aluminium tube 6 is replaced by a gas-tight enclosed pressure medium body intended to be subjected to a varying plastic deformation, for example a viscous liquid or, as shown in FIG. 4, a tube 17 of soft rubber. The rubber material in the tube 17 is strongly compressed by being pressed into the hollow cylinder 7 which forms a pressure chamber completely filled with soft rubber. The hollow cylinder 7 is provided with a lining 18 welded to it, which is adapted to fit a piston 19 formed at the end of the hollow cylinder 5. The pressure has the same value everywhere on the internal limiting surface of the pressure chamber in which the pressure medium body 17 is located. The lining 18 may be omitted, and the piston diameter is then equal to that of the hollow cylinder 7.

Upon heating, the length L of the pressure medium body 17 grows proportionally to the volume of the enclosed pressure medium and inversely proportionally to the effective piston surface of the flange 19. With a suitable choice of pressure medium volume and piston area it will be possible, upon heating, to achieve an apparent linear expansion which is much greater than when using an equally long metallic body. In other words, the aluminium tube 6 shown in FIG. 3 can be replaced by a pressure medium body, the length of which is only a fraction of the length of the tube, which means that in many cases a considerable reduction of the length of the clamping device is attained.

I claim:

1. Bushing for leading an electrical connector through a wall or the like, comprising an intermediate flange (1) for attachment in the wall, two metallic end flanges (3, 4) arranged on either side of the intermediate flange and two hollow insulating bodies (8, 9) clamped between the intermediate flange and the end flanges, and a bushing conductor (2, 22, 10) running the length of the whole bushing, said bushing conductor being movable in relation to at least one of the end flanges (3, 4), and a drawing member connected between the end flanges comprising a first (7) and a second (5) elongated metallic body, each of which is attached at one end to a corresponding end flange (3, 4), said bodies overlapping each other for a certain distance, and a pressure-transmitting member forming a power-transmitting connection between the ends of the metallic bodies which are not connected to the end flanges (3, 4).

2. Bushing according to claim 1, in which said insulating bodies are of ceramic material and said pressure-transmitting member is made of a material with greater average thermal expansion per unit of length than said first (7) and second (5) metallic bodies.

3. Bushing according to claim 2, in which said pressure-transmitting member consists of a third elongated metallic body (6).

4. Bushing according to claim 3, in which said first (7), second (5) and third (6) elongated metallic bodies are in the form of three coaxial cylinders, of which said third metallic body is a hollow cylinder positioned radially between the other bodies.

5. Bushing according to claim 3, in which said first (7) and second (5) elongated metallic bodies are made of steel, and said third (6) elongated metallic body is made of aluminium.

6. Bushing according to claim 1, in which said bushing conductor substantially consists of a tube (10) which surrounds said drawing member.

7. Bushing according to claim 6, in which said tube (10) together with a metal cylinder included in said drawing member limits a hollow-cylindrical space (16), which communicates, through circulation openings for coolant (13, 14), with a space (15) located radially outside said tube.

* * * * *